US009749727B2

(12) United States Patent
Tews et al.

(10) Patent No.: US 9,749,727 B2
(45) Date of Patent: Aug. 29, 2017

(54) FOLDING HEADSET EARPIECE

(71) Applicant: Plantronics, Inc., Santa Cruz, CA (US)

(72) Inventors: Erik Henry Tews, Santa Cruz, CA (US); John Kelley, Santa Cruz, CA (US); Jacob T Meyberg, Santa Cruz, CA (US); Roman M Duran, Ben Lomond, CA (US)

(73) Assignee: Plantronics, Inc., Santa Cruz, CA (US)

( * ) Notice: Subject to any disclaimer, the term of this patent is extended or adjusted under 35 U.S.C. 154(b) by 21 days.

(21) Appl. No.: 14/743,642

(22) Filed: Jun. 18, 2015

(65) Prior Publication Data

US 2016/0373848 A1 Dec. 22, 2016

(51) Int. Cl.
*H04R 25/00* (2006.01)
*H04R 1/10* (2006.01)

(52) U.S. Cl.
CPC ..... *H04R 1/1008* (2013.01)

(58) Field of Classification Search
USPC ..... 181/128, 129; 381/72
See application file for complete search history.

(56) References Cited

U.S. PATENT DOCUMENTS 5,357,585 A * 10/1994 Kumar ..... H04R 1/1008 379/430
5,519,783 A * 5/1996 Kumar ..... H04R 1/1008 181/129
2007/0036386 A1* 2/2007 Amae ..... H04M 1/05 381/388
2007/0092098 A1* 4/2007 Kaderavek ..... H04R 1/1066 381/370
2008/0025524 A1* 1/2008 Vaudrey ..... A61F 11/12 381/72
2010/0020982 A1* 1/2010 Brown ..... H03G 3/20 381/74
2012/0140973 A1* 6/2012 Olodort ..... H04R 1/1066 381/375
2013/0272560 A1* 10/2013 Dougherty ..... H04R 1/1066 381/378
2014/0321661 A1* 10/2014 Alao ..... H04R 1/105 381/74
2015/0222980 A1* 8/2015 Pizzaro ..... H04R 1/1058 381/371

* cited by examiner

*Primary Examiner* — Quoc D Tran

(57) ABSTRACT

A headset earpiece comprises a faceplate; and at least one flange pivotably connected to the faceplate.

18 Claims, 13 Drawing Sheets

FOLDING HEADSET EARPIECE

FIELD

The present disclosure relates generally to the field of headsets. More particularly, the present disclosure relates to folding a headset for more convenient storage.

BACKGROUND

This background section is provided for the purpose of generally describing the context of the disclosure. Work of the presently named inventor(s), to the extent the work is described in this background section, as well as aspects of the description that may not otherwise qualify as prior art at the time of filing, are neither expressly nor impliedly admitted as prior art against the present disclosure.

Headsets have many purposes. They can be used for enjoying music, making phone calls, or simply protecting the ears from noise or the cold. One sought-after feature of a headset is its ability to collapse into a more compact shape for more convenient storage. Many solutions have been implemented. One class of solutions employs hinges or pivots that allow the headband to fold or rotate into a more compact shape. Another class of solutions allows the earpieces to rotate with respect to the headband to achieve a more compact shape. These solutions tend to be unwieldy or overly complex, and fail to preserve the pure and simple aesthetic form of the headset sought by the designers and consumers.

SUMMARY

In general, in one aspect, an embodiment features a headset earpiece comprising: a faceplate; and at least one flange pivotably connected to the faceplate.

Embodiments of the headset earpiece may include one or more of the following features. Some embodiments comprise a hinge pivotably connecting the at least one flange to the faceplate. In some embodiments, the hinge comprises: a friction hinge. Some embodiments comprise at least one spring configured to urge the at least one flange to rotate with respect to the faceplate. In some embodiments, the at least one spring comprises at least one of: a first torsion spring configured to urge the at least one flange and the faceplate to be substantially coplanar; and a second torsion spring configured to urge the at least one flange and the faceplate to be substantially orthogonal. Some embodiments comprise a cam; wherein the at least one spring comprises a leaf spring; wherein a lobe of the cam deflects the leaf spring when the at least one flange and the faceplate are neither substantially coplanar nor substantially orthogonal. In some embodiments, the at least one spring comprises: a bistable spring configured to urge the at least one flange and the faceplate to be either substantially coplanar or substantially orthogonal. In some embodiments, the at least one spring comprises: an elastic band configured to urge the at least one flange and the faceplate to be either substantially coplanar or substantially orthogonal. Some embodiments comprise a stop configured to limit relative rotation of the at least one flange and the faceplate. Some embodiments comprise at least one ear cushion. Some embodiments comprise a speaker. Some embodiments comprise a microphone. Some embodiments comprise a receiver. Some embodiments comprise a transmitter. Some embodiments comprise an antenna.

Some embodiments comprise a don/doff detector. Some embodiments comprise a headband coupled to the headset earpiece.

The details of one or more implementations are set forth in the accompanying drawings and the description below. Other features will be apparent from the description and drawings, and from the claims.

DESCRIPTION OF DRAWINGS

The leading digit(s) of each reference numeral used in this specification indicates the number of the drawing in which the reference numeral first appears.

In FIG. 5A, the earpiece is unfolded.

DETAILED DESCRIPTION

Embodiments of the present disclosure provide folding headset earpieces. These folding headset earpieces allow headsets to be easily reduced to a more compact shape for storage while preserving the pure and simple aesthetic form of the headset sought by the designers and consumers. These folding headset earpieces may be employed alone or in pairs, and may include speakers, microphones, transmitters and the like. Other features are contemplated as well.

Figure 1B:
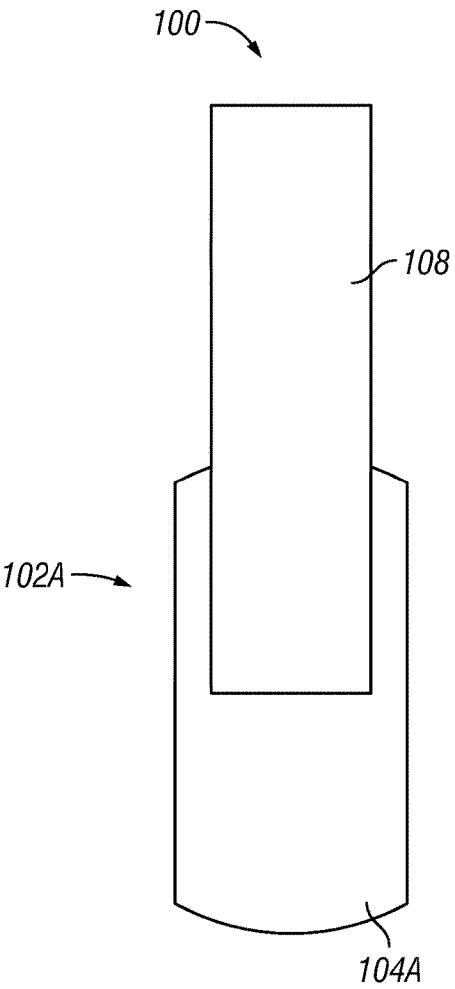
FIG. 1B shows a side view of the headset of FIG. 1 with the earpieces unfolded.
Figure 1A:
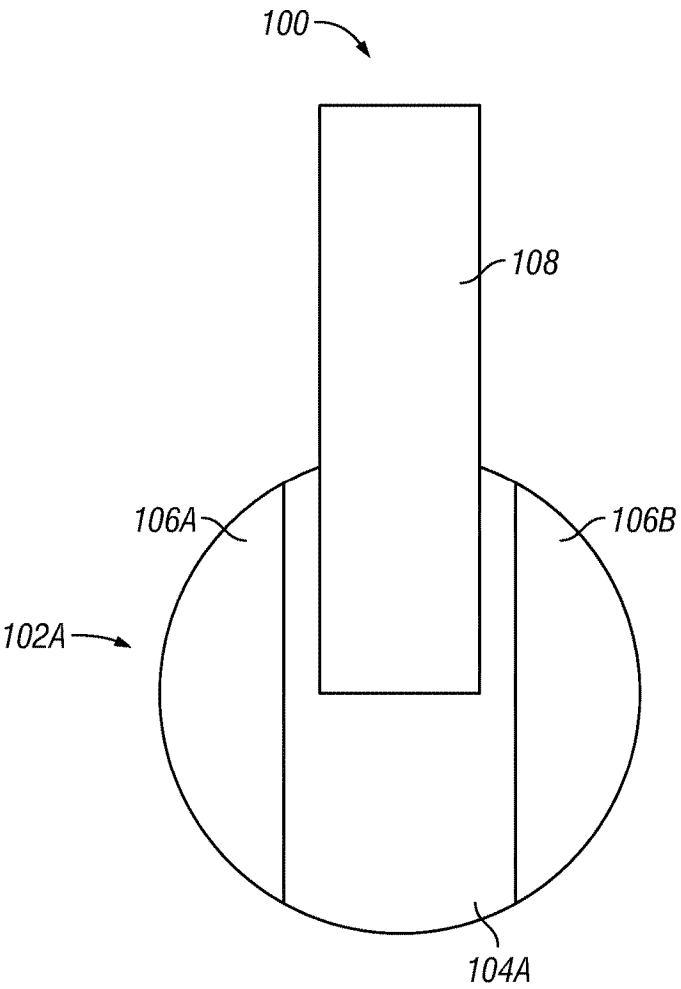
FIG. 1A shows a side view of a headset with two earpieces folded.
Figure 2B:
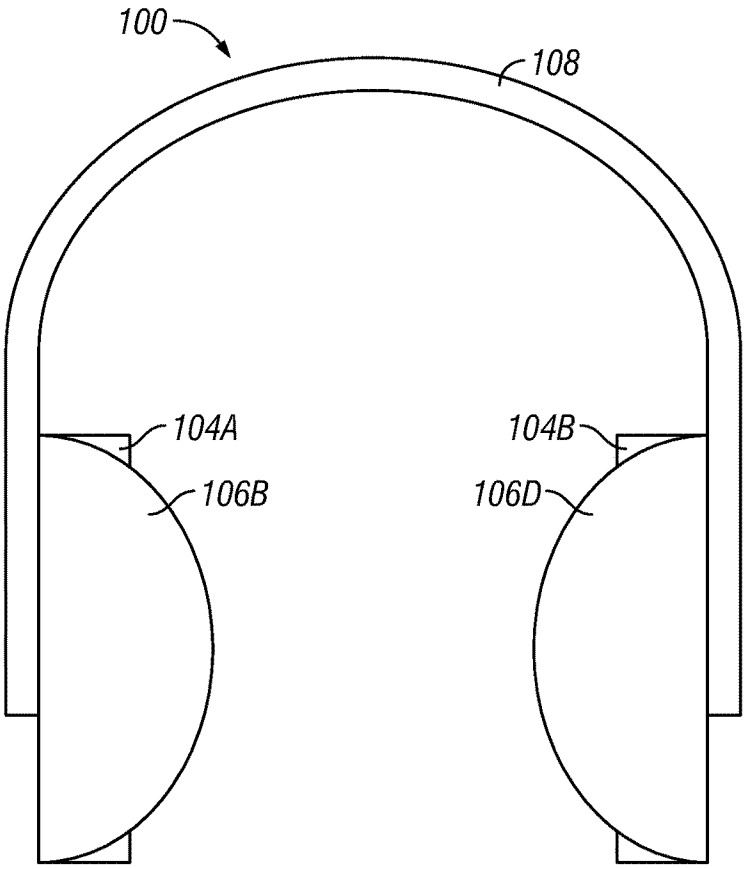
FIG. 2B shows a side view of the headset of FIG. 1 with the earpieces folded.
Figure 2A:
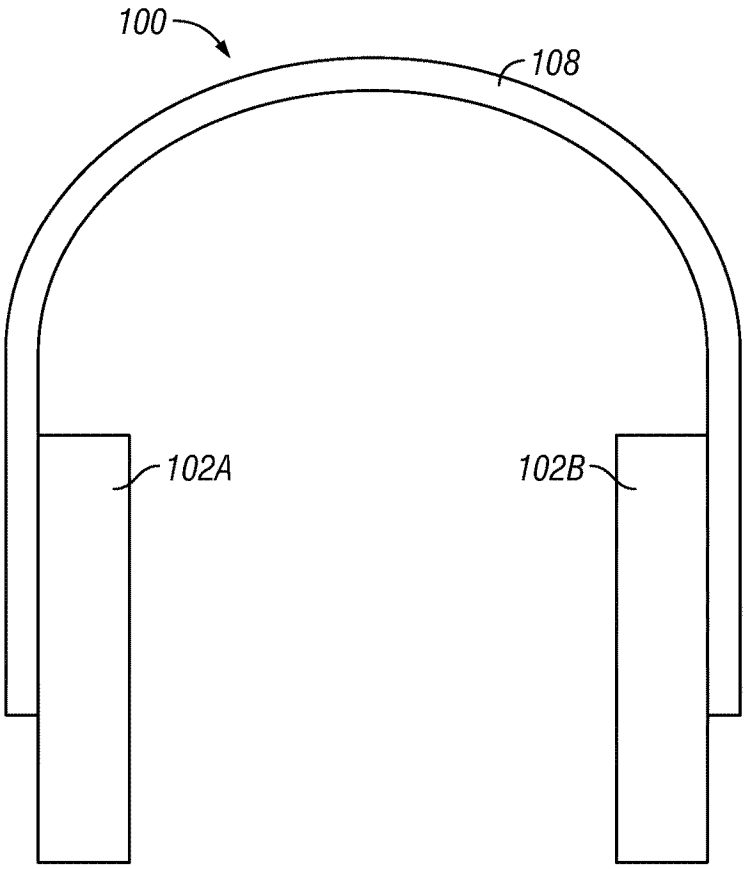
FIG. 2A shows a front view of the headset of FIG. 1 with the earpieces unfolded.

FIGS. 1A,B and 2A,B show elements of a headset 100 having folding earpieces 102 according to some embodiments. FIG. 1A shows a side view of the headset 100 with two earpieces 102A and 102B folded. FIG. 1B shows a side view of the headset 100 with the earpieces 102A and 102B unfolded. FIG. 2A shows a front view of the headset 100 with the earpieces 102A and 102B unfolded. FIG. 2B shows a side view of the headset 100 with the earpieces 102A and 102B folded. Each earpiece 102A,B may include a faceplate 104A,B and two flanges 106A,B,C,D (flange 106C is not shown). Each faceplate 104A,B may be mounted on a headband 108.

Figure 3B:
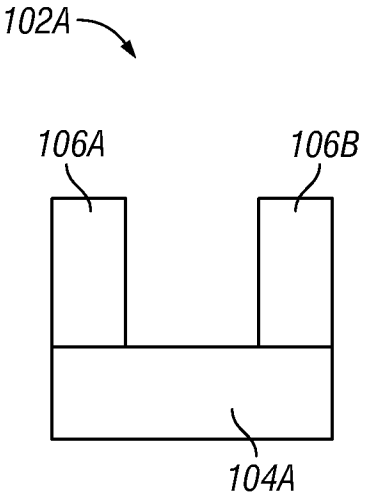
FIG. 3B shows the earpiece of FIG. 1 folded.
Figure 3A:
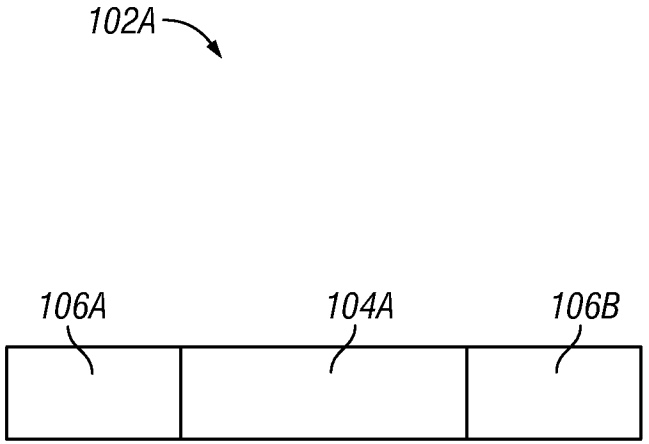
FIG. 3A shows an earpiece of FIG. 1 unfolded.

FIGS. 3A and 3B show top views of the earpiece 102A. FIG. 3A shows the earpiece 102A unfolded, where the flanges 106A,B and the faceplate 104A are substantially coplanar. FIG. 3B shows the earpiece 102 folded, where the flanges 106A,B and the faceplate 104A are substantially orthogonal.

Figure 4A:
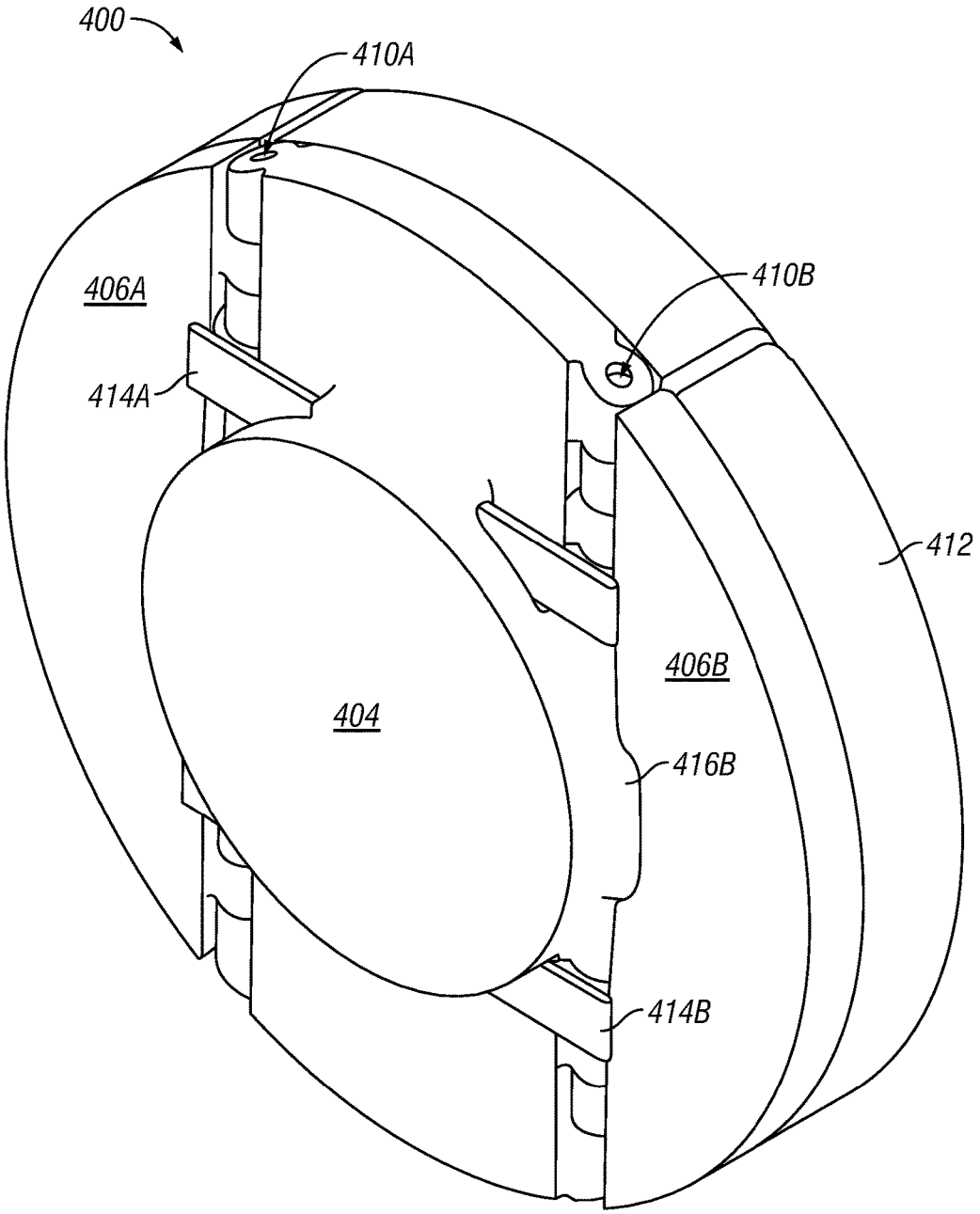
FIGS. 4A and 4B show elements of a folding earpiece according to an embodiment that employs leaf springs.
Figure 4B:
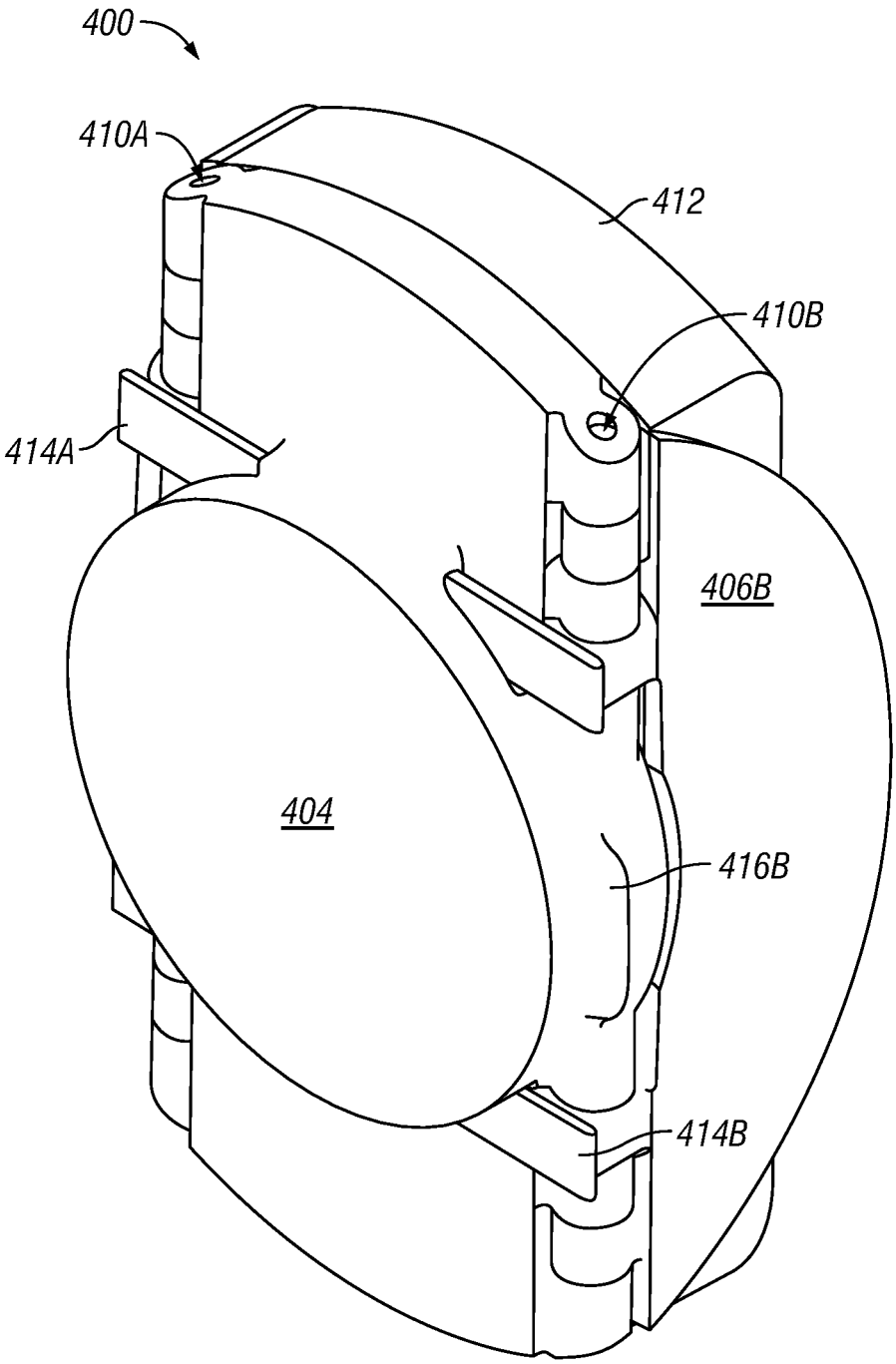

FIGS. 4A and 4B show elements of a folding earpiece 400 according to an embodiment that employs leaf springs. Folding earpiece 400 may include a faceplate 404 pivotably connected to two flanges 406A,B by respective hinges 410A,B. One or more cushions 412 may be mounted on faceplate 404 and flanges 406A,B. Leaf springs 414A,B are held against hinges 410A,B by faceplate 404. Faceplate 404 includes stops 416A (not shown) and 416B, which prevent the over-rotation of flanges 406A,B with respect to faceplate 404.

Figure 5A:
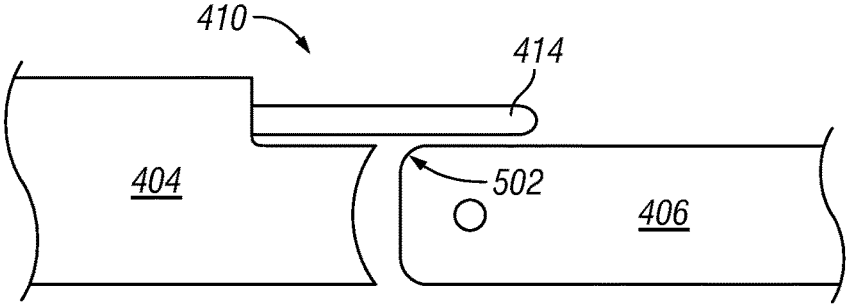
FIGS. 5A,B,C show detail of a hinge for an earpiece according to one embodiment.
Figure 5B:
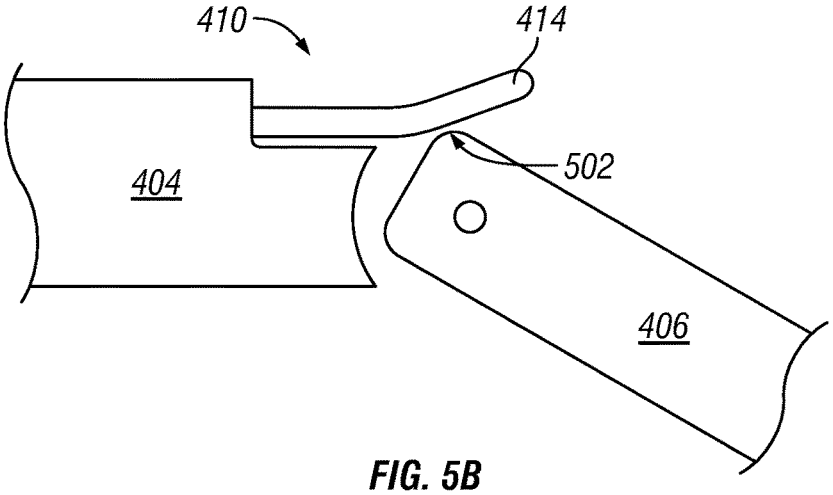
In FIG. 5B, the earpiece is neither folded nor unfolded.
Figure 5C:
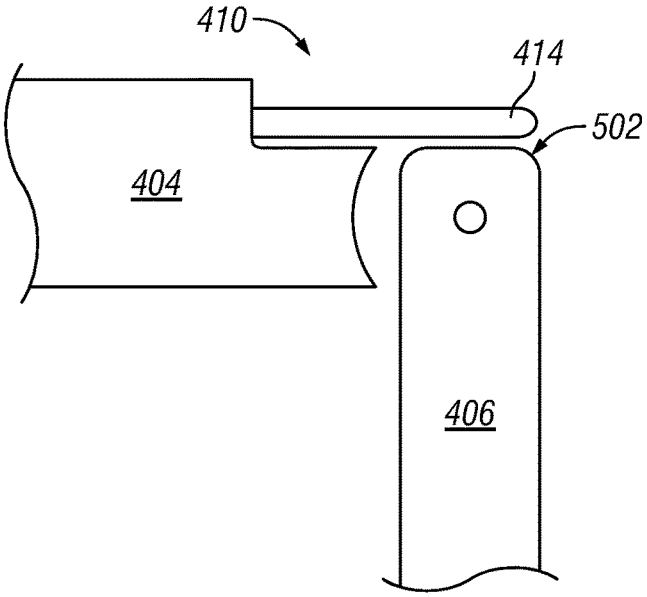
In FIG. 5C, the earpiece is folded.

FIGS. 5A,B,C show detail of a hinge 410 according to one embodiment. A lobe 502 is formed in a flange 406 of the earpiece 400. In FIG. 5A, the earpiece 400 is unfolded, with faceplate 404 and flange 406 substantially coplanar, and the leaf spring 414 is not deflected by the lobe 502. In FIG. 5C, the earpiece 400 is folded, the faceplate 404 and the flange 406 are substantially orthogonal, and again the leaf spring 414 is not deflected by the lobe 502. But in FIG. 5B, where the earpiece 400 is neither folded nor unfolded and consequently the flange 406 and the faceplate 404 are neither substantially coplanar nor substantially orthogonal, the leaf spring 414 is deflected by the lobe 502, and therefore tends to urge the flange 406 and the faceplate 404 to be either substantially coplanar or substantially orthogonal.

Figure 6A:
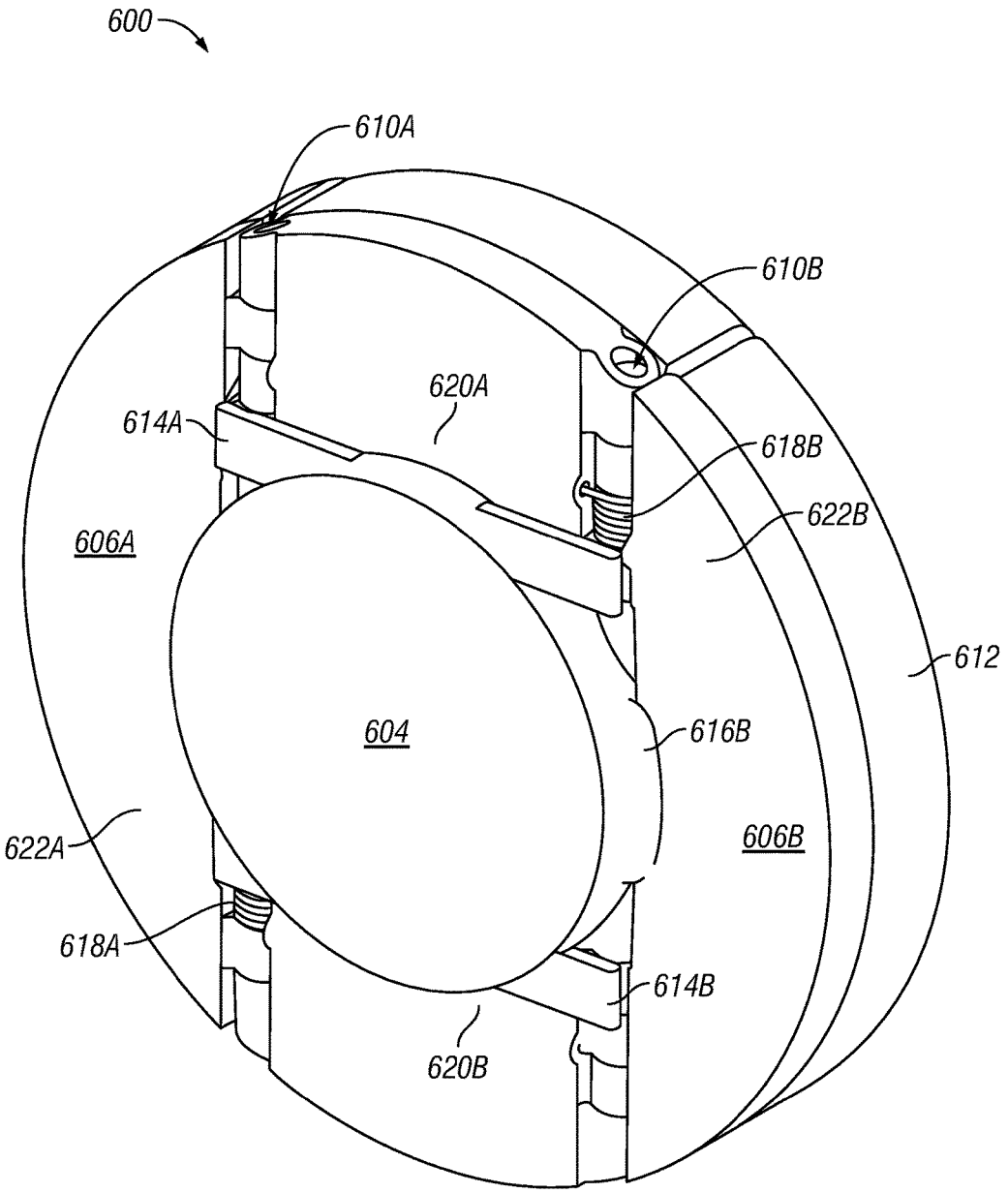
FIGS. 6A and 6B show elements of a folding earpiece according to an embodiment that employs leaf springs and torsion springs.
Figure 6B:
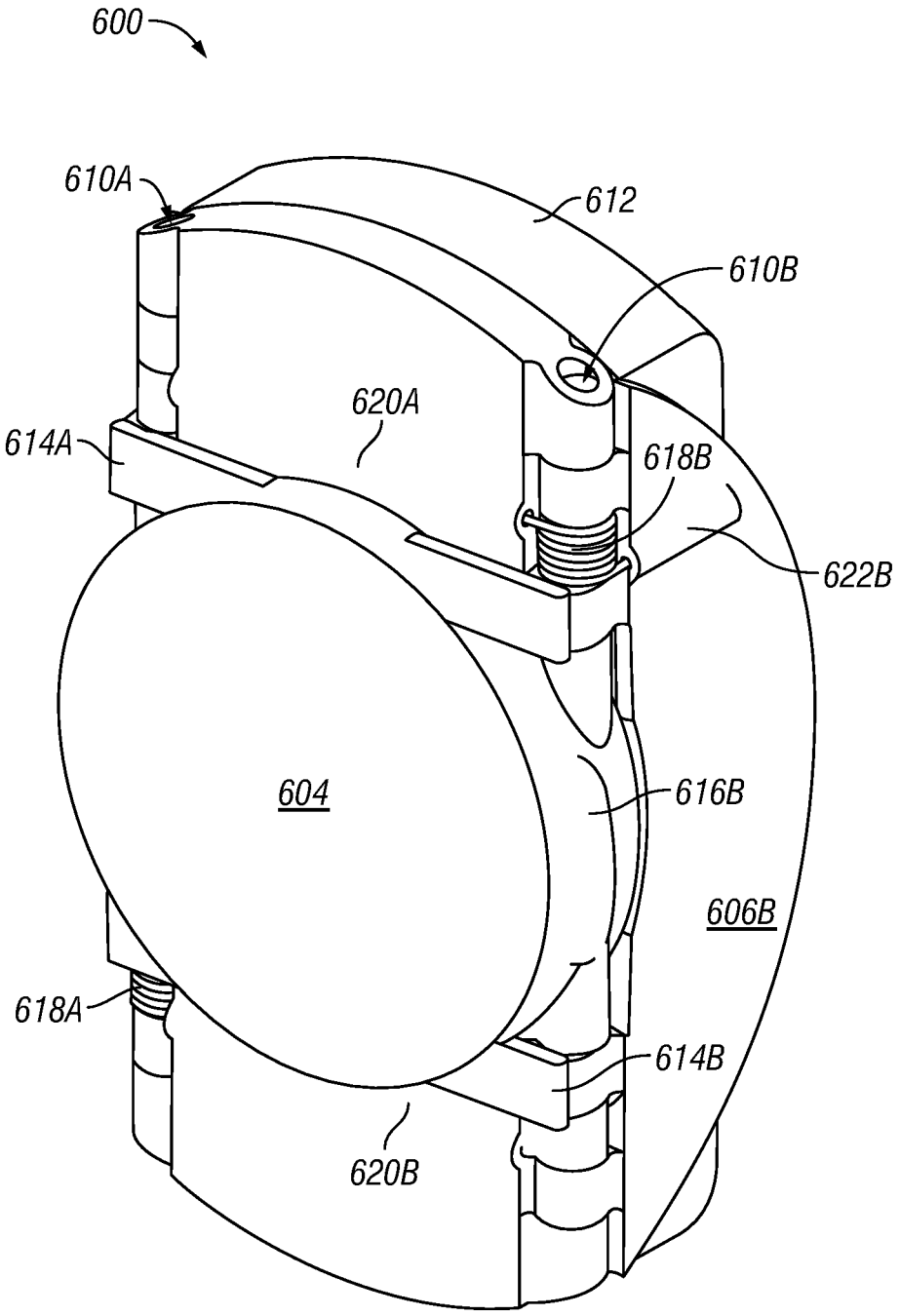

FIGS. 6A and 6B show elements of a folding earpiece 600 according to an embodiment that employs leaf springs and torsion springs. Folding earpiece 600 may include a faceplate 604 pivotably connected to two flanges 606A,B by respective hinges 610A,B. One or more cushions 612 may be mounted on faceplate 604 and flanges 606A,B. Faceplate 604 includes stops 616A (not shown) and 616B, which prevent the over-rotation of flanges 606A,B with respect to faceplate 604.

Leaf springs 614A,B are held against hinges 610A,B by faceplate 604. Torsion springs 618A,B are wrapped around pins of hinges 610A,B respectively, with spring ends held in place by holes 620A,B formed in faceplate 604, hole 622A formed in flange 606A, and hole 622B formed in flange 606B. Torsion springs 618 may be tensioned to both urge the earpiece 600 to fold, to both urge the earpiece 600 to unfold, or one to urge the earpiece 600 to fold and the other to urge the earpiece 600 to unfold. In some embodiments, more torsion springs 618 may be used. Lobes 502 may be formed in flanges 606 as described above with reference to FIGS. 5A,B,C. In some embodiments, the leaf springs 614 are not included.

Figure 7A:
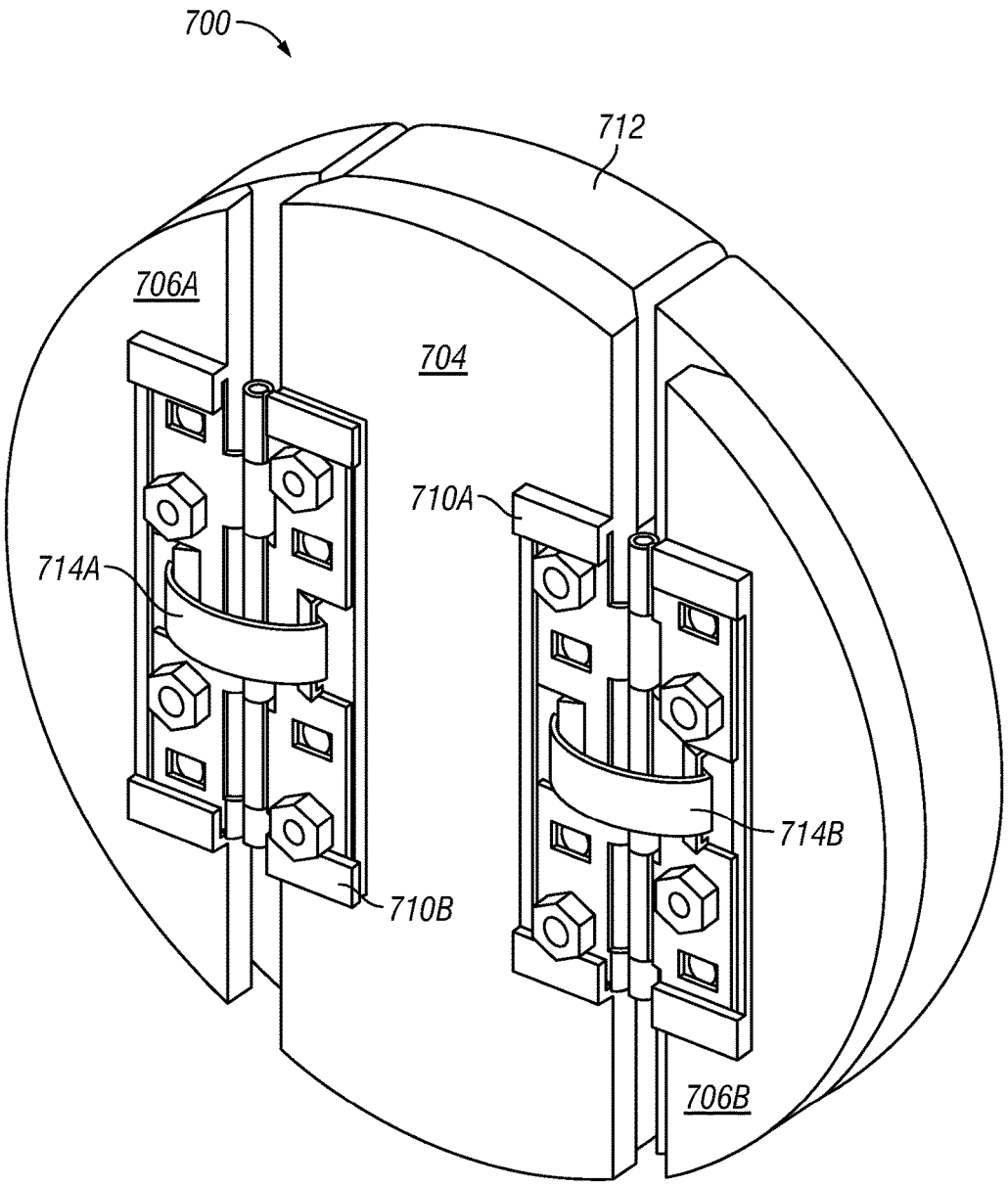
FIGS. 7A and 7B show elements of a folding earpiece according to an embodiment that employs bistable springs.
Figure 7B:
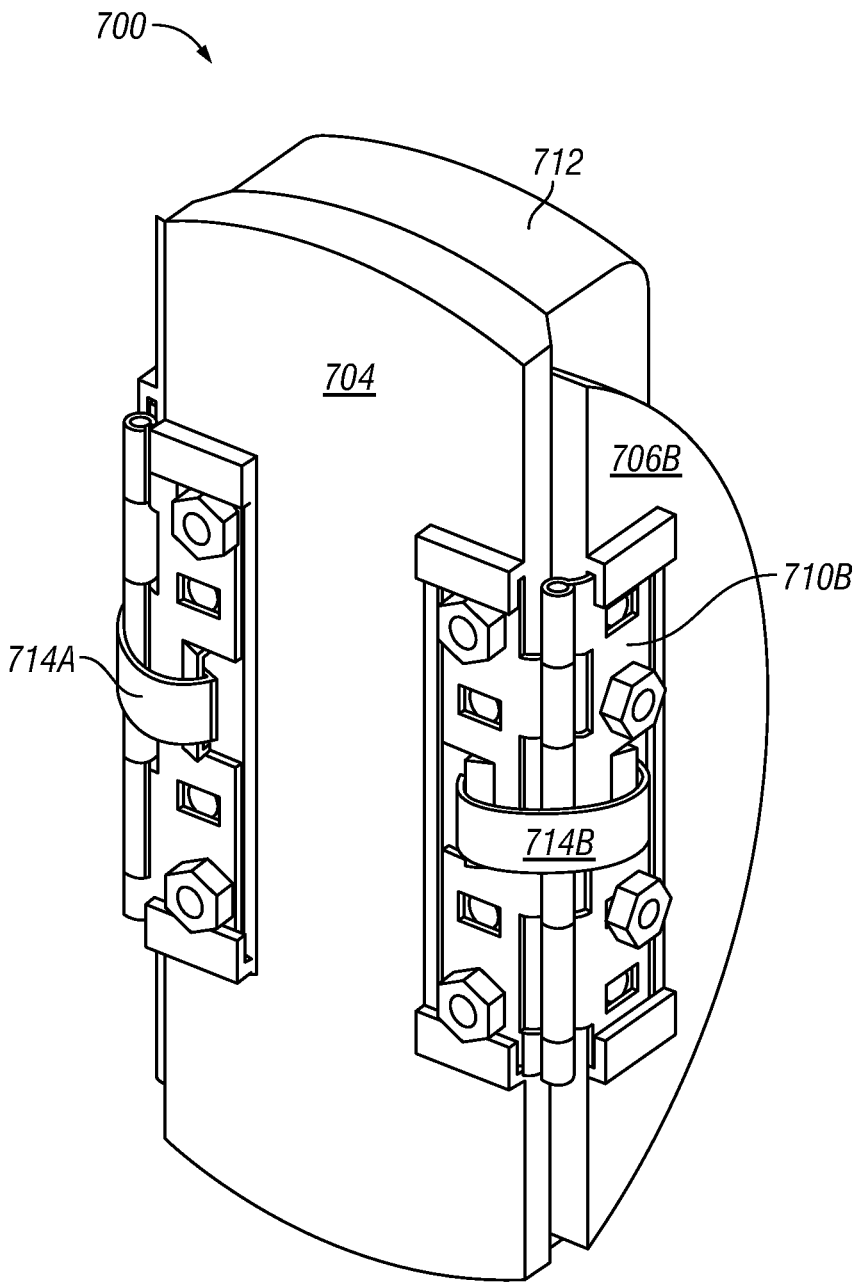

FIGS. 7A and 7B show elements of a folding earpiece 700 according to an embodiment that employs bistable springs. Folding earpiece 700 may include a faceplate 704 pivotably connected to two flanges 706A,B by respective hinges 710A,B. One or more cushions 712 may be mounted on faceplate 704 and flanges 706A,B. The ends of bistable springs 714A,B are disposed within slots formed in hinges 710A,B such that bistable springs 714A,B tend to urge the flanges 706 and the faceplate 704 to be either substantially coplanar or substantially orthogonal.

Figure 8A:
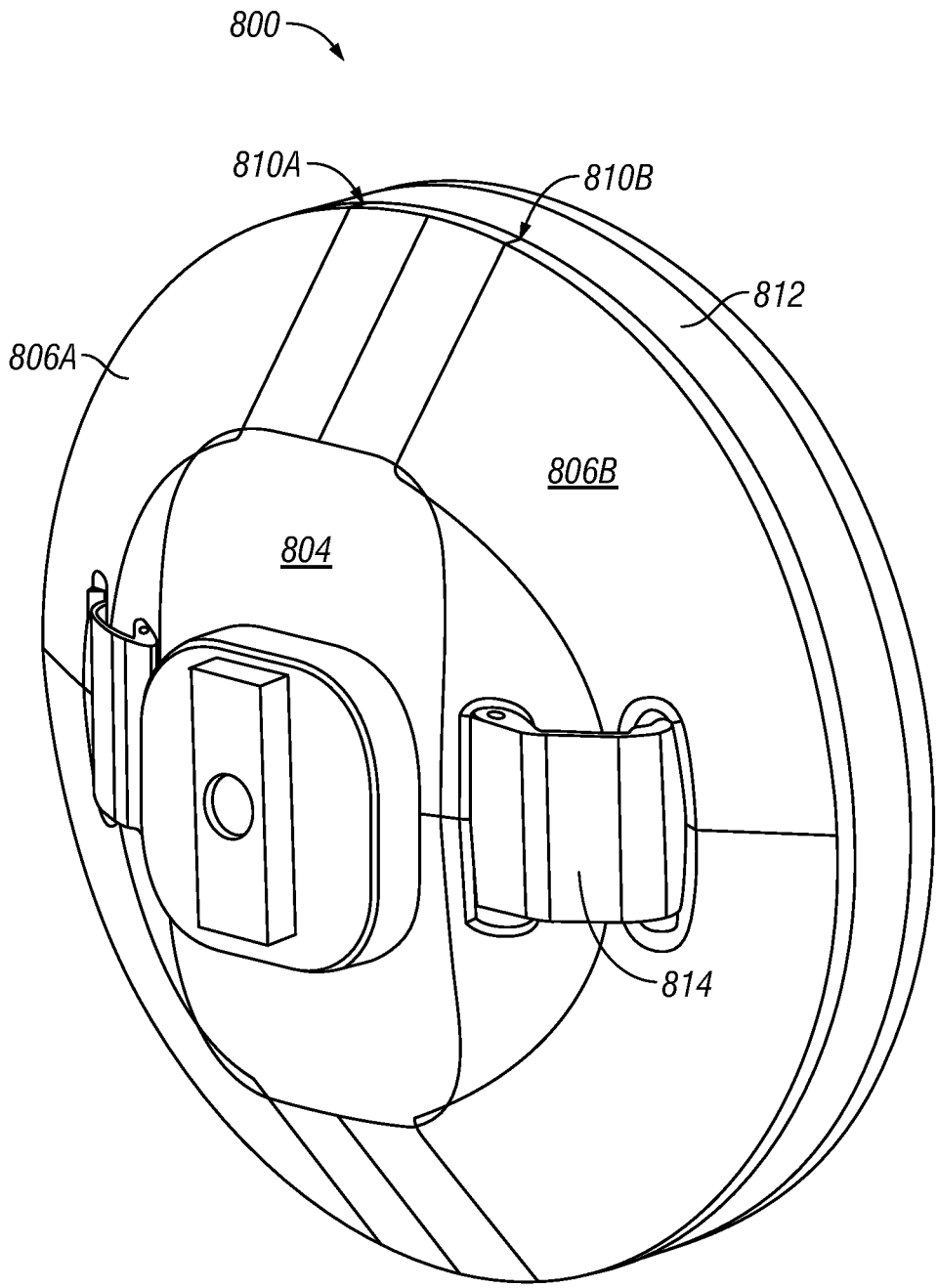
FIGS. 8A and 8B show elements of a folding earpiece according to an embodiment that employs an elastic band.
Figure 8B:
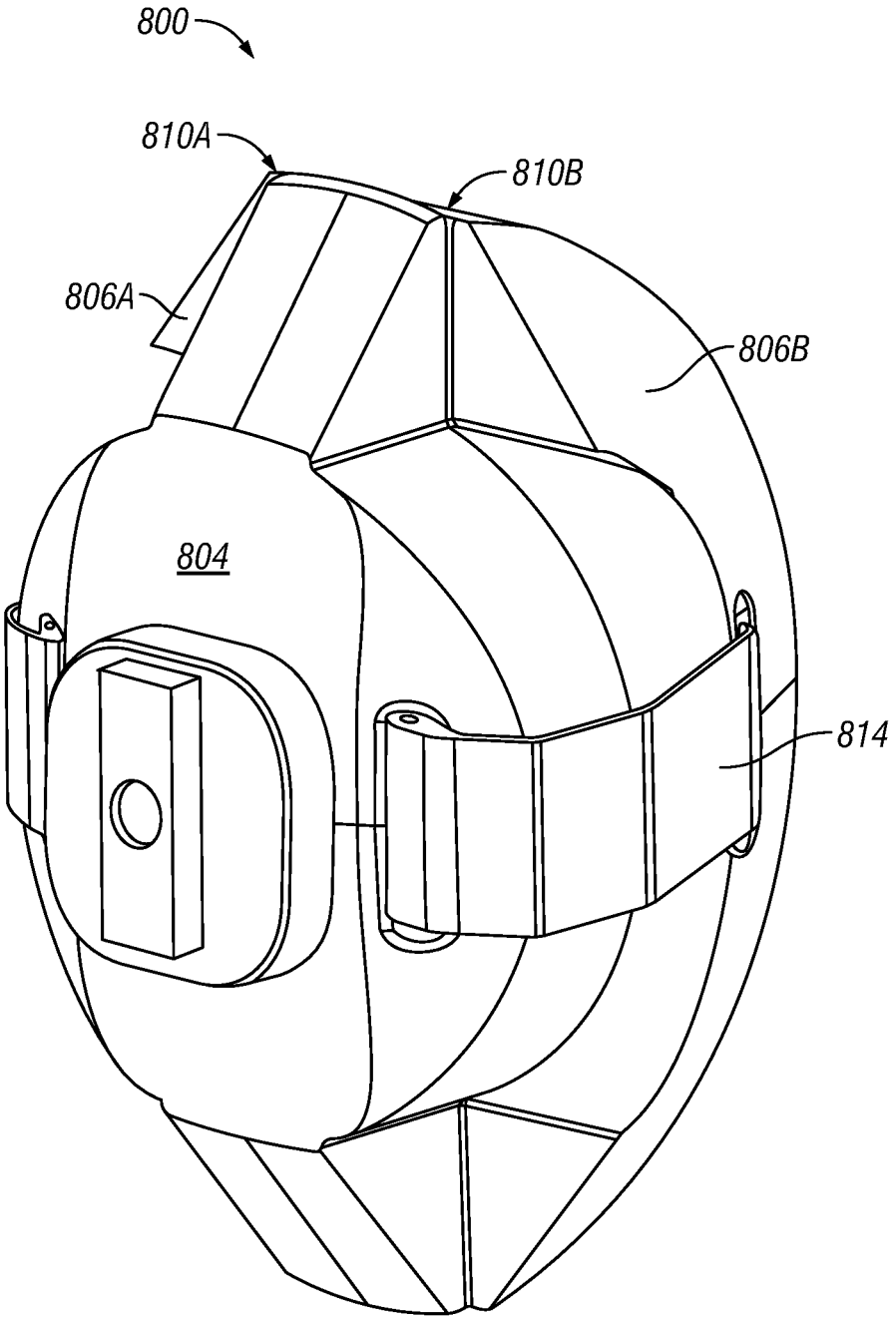

FIGS. 8A and 8B show elements of a folding earpiece 800 according to an embodiment that employs an elastic band. Folding earpiece 800 may include a faceplate 804 pivotably connected to two flanges 806A,B by respective hinges 810A,B. The hinges 810 may be implemented as one or more pieces of fabric affixed to the faceplate 804 and the flanges 806A,B. One or more cushions 812 may be mounted on faceplate 804 and flanges 806A,B. One or more elastic bands 814 are disposed within slots formed in the faceplate 804 and the flanges 806A,B such that the elastic band(s) 814 tend to urge the flanges 806 and the faceplate 804 to be either substantially coplanar or substantially orthogonal. The hinges 810A,B may be implemented as living hinges.

Figure 9:
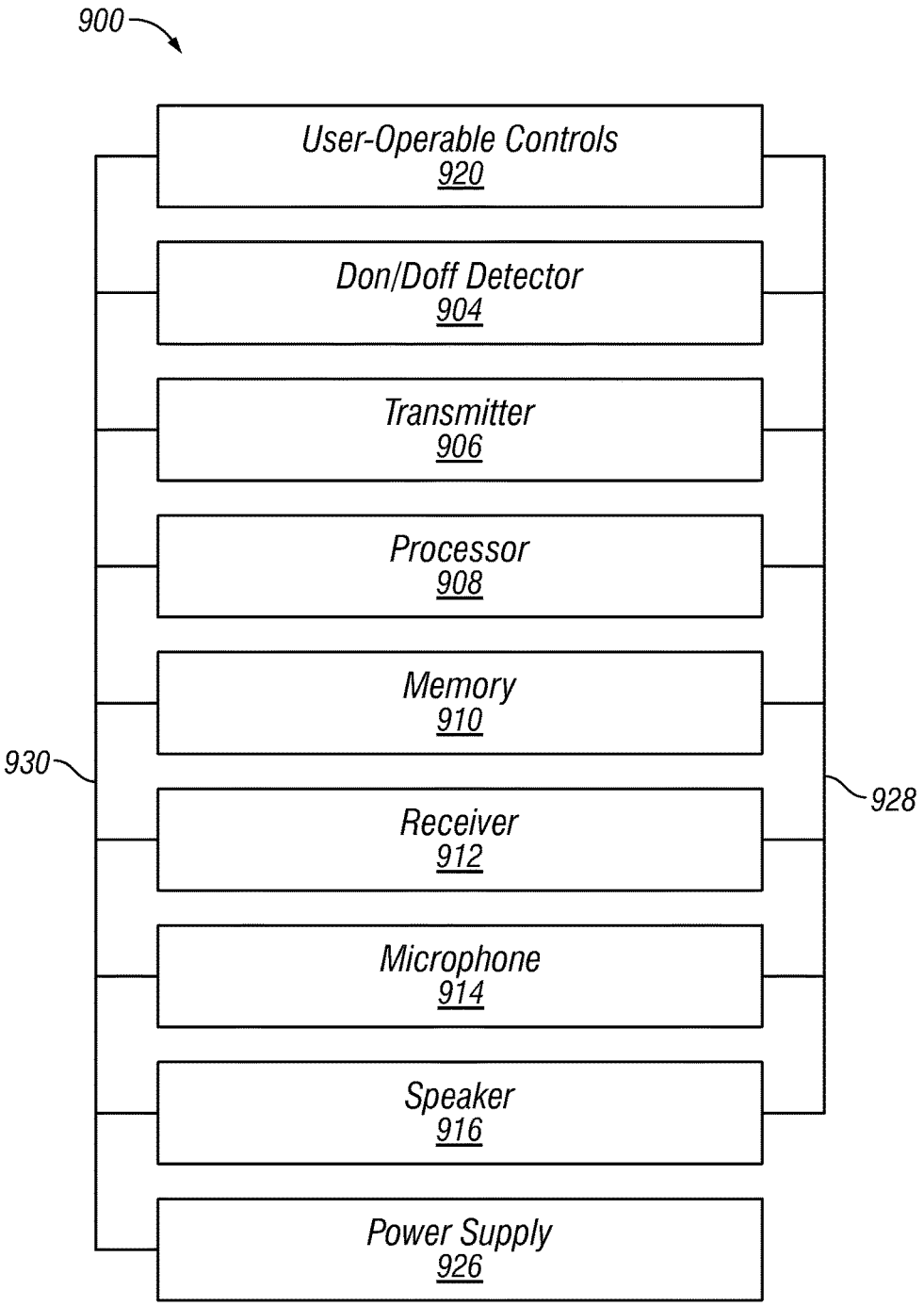
FIG. 9 shows elements of a headset according to one embodiment.

FIG. 9 shows elements of a headset 900 according to one embodiment. Although in the described embodiment elements of the headset 900 are presented in one arrangement, other embodiments may feature other arrangements. For example, elements of the headset 900 may be implemented in hardware, software, or combinations thereof. As another example, various elements of the headset 900 may be implemented as one or more digital signal processors.

Referring to FIG. 9, the headset 900 may include one or more of a don/doff detector 904, a transmitter 906, and a processor 908. The headset 900 may also include one or more of a memory 910, a receiver 912, a microphone 914, a speaker 916, one or more user-operable controls 920, and a power supply 926. The headset 900 may include other elements as well. The processor may communicate with other elements of the headset 900 over one or more communication busses 928. The elements of headset 900 may receive power from the power supply 926 over one or more power rails 930. Various elements of the headset 900 may be implemented as one or more integrated circuits.

The don/doff detector 904 may be implemented as one or more capacitive sensors or the like. The transmitter 906 and the receiver 912 may employ any communication protocol, including wired and wireless communication protocols. The wireless protocols may include Bluetooth, Wi-Fi, Digital Enhanced Cordless Telecommunications (DECT), and the like. The transmitter 906 and the receiver 912 may employ multiple communication protocols. The processor 908 may include digital signal processors, analog-to-digital converters, digital-to-analog converters, and the like. The user-operable controls 920 may include buttons, slide switches, capacitive sensors, touch screens, and the like.

A number of implementations have been described. Nevertheless, various modifications may be made without departing from the scope of the disclosure. For example, the hinges/pivots may be hidden from view by a cover made from cushions, covers, or the like. The hinges/pivots may be implemented as friction hinges. The hinges may be implemented as living hinges. For example the faceplate, flanges, and hinges may be formed from a single piece of material where the hinges are thin enough to flex. The earpieces may be implemented with detents that hold the earpiece in the folded and/or unfolded position(s) but otherwise permit folding and unfolding of the earpieces. The earpieces may include a motor to operate the faceplates and flanges, for example in response to a user-operable control, automatically on connection with another device, on establishment of a link with a link partner, or the like. Accordingly, other implementations are within the scope of the following claims.

What is claimed is:

1. A folding headset earpiece comprising at least a faceplate;

a head mount, coupled to the faceplate and configured to allow wearing the headset during use; and at least two flanges, which flanges are pivotably connected to the faceplate to allow folding the earpiece.

2. The headset earpiece of claim 1, further comprising at least two hinges, pivotably connecting the at least two flanges to the faceplate.

3. The headset earpiece of claim 2, wherein each hinge comprises a friction hinge.

4. The headset earpiece of claim 1, further comprising:

at least one spring configured to urge at least one of the flanges to rotate with respect to the faceplate.

5. The headset earpiece of claim 4, wherein the at least one spring comprises at least one of:

a first torsion spring configured to urge at least one of the flanges and the faceplate to be substantially coplanar; and a second torsion spring configured to urge the at least one flange and the faceplate to be substantially orthogonal.

6. The headset earpiece of claim 4, further comprising:

a cam;

wherein the at least one spring comprises a leaf spring;

wherein a lobe of the cam deflects the leaf spring when at least one of the flanges and the faceplate are neither substantially coplanar nor substantially orthogonal.

7. The headset earpiece of claim 4, wherein the at least one spring comprises a bistable spring configured to urge at least one of the flanges and the faceplate to be either substantially coplanar or substantially orthogonal.

8. The headset earpiece of claim 4, wherein the at least one spring comprises an elastic band configured to urge at least one of the flanges and the faceplate to be either substantially coplanar or substantially orthogonal.

9. The headset earpiece of claim 1, further comprising a stop configured to limit relative rotation of at least one of the flanges and the faceplate.

10. The headset earpiece of claim 1, wherein the at least two flanges can be brought into at least an operating position and a storage position.

11. The headset earpiece of claim 10, wherein the position can be changed by pivoting the at least two flanges.

12. The headset earpiece of claim 10, wherein the faceplate is arranged along a main plane, the earpiece in the operating position spans a first surface area in said main plane, and the earpiece in the storage position spans a second surface area in said main plane, wherein the second surface area is smaller than the first surface area.

13. The headset earpiece of claim 1, wherein a first of the flanges is pivotably connected with the faceplate along a first axis and a second of the flanges is pivotably connected with the faceplate along a second axis, and wherein the first and second axes are substantially parallel to each other.

14. A headset comprising at least one folding headset earpiece and a head mount, the earpiece comprising at least a faceplate and two or more flanges, which flanges are pivotably connected to the faceplate to allow folding the earpiece, wherein the head mount is coupled to the faceplate and configured to allow wearing the headset during use.

15. The headset of claim 14, wherein the head mount comprises a headband, connected with the faceplate at an end section of the headband, wherein the at least two flanges are pivotably connected to the faceplate around at least two associated pivot axes, which pivot axes being arranged substantially parallel to or identical with a main axis of the end section of the headband.

16. The headset of claim 14, comprising at least two of said folding headset earpieces.

17. The headset of claim 14, further comprising a don/doff detector.

18. The headset of claim 14, wherein the head mount comprises a headband coupled to the headset earpiece.

* * * * *